US005146772A

United States Patent [19]

Hamada et al.

[11] Patent Number: 5,146,772

[45] Date of Patent: * Sep. 15, 1992

[54] VEHICLE DOOR LOCK DEVICE

[75] Inventors: Yoshikazu Hamada; Yozo Ogino, both of Utsunomiya, Japan

[73] Assignee: Mitsui Kinzoku Kogyo Kabushiki Kaisha, Tokyo, Japan

[ * ] Notice: The portion of the term of this patent subsequent to Apr. 9, 2008 has been disclaimed.

[21] Appl. No.: 658,599

[22] Filed: Feb. 21, 1991

[30] Foreign Application Priority Data

Feb. 22, 1990 [JP] Japan ..... 2-41638

[51] Int. Cl.[5] ..... E05B 65/36

[52] U.S. Cl. ..... 70/264; 292/201; 292/336.3

[58] Field of Search ..... 70/264, 257; 292/201, 292/DIG. 3, 336.3

[56] References Cited

U.S. PATENT DOCUMENTS

| | | | |
|---|---|---|---|
| 2,186,546 | 1/1940 | Lakin | 70/264 |
| 4,223,927 | 9/1980 | Kobayashi et al. | 292/336.3 |
| 4,364,249 | 12/1982 | Kleefeldt | 70/264 |
| 5,005,392 | 4/1991 | Shibata | 70/264 |
| 5,046,341 | 9/1991 | Ogino et al. | 70/264 |

*Primary Examiner*—Renee S. Luebke
*Assistant Examiner*—Darnell M. Boucher
*Attorney, Agent, or Firm*—Browdy and Neimark

[57] ABSTRACT

A vehicle door lock device has a synthetic resin made body and a back plate attached on the rear side of the body. A lock lever is journalled between the back plate and the body in order to change-over the lock device between its locked condition and unlocked condition. A plastic made actuator box containing a power source for powerfully changing-over the lock lever is placed below the body. A switch box is formed at a rear side of the box and a switch body is contained in the switch box. A rotation shaft of the switch body protrudes rearward through the switch box and a switch arm is secured to the protruded portion of the rotation shaft. At the overlap position of the connecting lever and the lock lever, the connecting lever is installed rotatably, one end of the lever being connected to the switch arm and another end of it being connected to the key cylinder of a door or the lock lever. The switch body is electrically connected to the lock devices of other doors, functions co-operatively motion of the key cylinder or lock lever, and sends out control signal for changing-over the lock devices of the other doors between their locked condition and unlocked condition. The switch box is installed at a position where it is not overlapped with the lock lever. The switch box has a circumferential wall protruded integrally from the actuator box and a lid formed separately from the actuator box, and the bottom plate of the actuator box is used simultaneously as an outer wall of the actuator box. The lid of the actuator box is even with the back plate or higher than the back plate outward.

4 Claims, 3 Drawing Sheets

VEHICLE DOOR LOCK DEVICE

FIELD OF THE INVENTION

The present invention relates to a switch mechanism for a vehicle door lock device, and in particular to a switch mechanism detecting a change-over condition of a lock lever and the like in the lock device installed in the driver's door and outputting a control signal for changing-over other door lock devices to a locked condition or an unlocked condition.

BACKGROUND OF THE INVENTION

The applicant of this application has filed a invention of the vehicle door lock device as shown in FIG. 1 with the Japanese Patent Office with a number of Patent application No. 1-160238 (corresponding to the U.S. Pat. application Ser. No. 07/537,970, now U.S. Pat. No. 5,005,392).

Depicting in a rear view of FIG. 1, the vehicle door lock device has a body (a) made of synthetic resin, a cover plate made of a metal sheet applied to the front side of the body (a), and a back plate (b) made of a metal sheet applied to the rear side of the body (a). These plates are secured integrally to the body (a) by means of screws. To the body (a), a latch engaged with a striker and a ratchet preventing the latch from reverse-rotating are rotatably journalled. At a position below the body (a), an actuator box (c) made of synthetic resin is placed, which actuator box is formed integrally with the body (a) or as a different structure. Explicitely, the actuator box (c) has a motor chamber (d) and a speed reducer (e).

According to the construction of the prior art, a lock lever (f) is rotatably journalled to the body (a) at the position between the motor chamber (d) and the back plate (b). A switch box (g) is fixed to the rear side of the back plate (b) through a screw (h). The switch box (g) is positioned so as to make an axis of the shaft (1) of the box (g) aligned with the center axis of the lock lever (f). A switch arm (j) is secured to the shaft (1) and an front end of the arm (j) is aligned with an oval hole (i) formed at a front end of the lock lever (f). An end portion of a rod (k) joined to a key cylinder in the door is engaged with the front ends of the oval hole (i) and the switch arm (j).

It is noted that the switch box (g) is attached to the lock device at the driver's door. When the lock lever (f) is rotated by a key manipulation or the like, the switch box (g) detects the rotation of the lock lever (f), outputting a control signal for locking or unlocking the lock devices in other doors.

The first problem of the conventional structure of the lock device resides in an overlapping arrangement of the switch box (g) and the lock lever (f) at a position below, the back plate (b). Explaining the arrangement more concretely, a guide rail extending perpendicularly so as to support glass panes of the doors is secured to the rear side of the back plate (b). The switch box (g) has, however, a thickness exceedingly thicker than the lever and arm, so that a large stepped portion is formed on the rear side of the back plate (b), causing a disadvantage in a securing work of the guide rail and effecting on the shape of the glass panes.

The second disadvantage of the conventional structure is the construction of the switch box (g). According to the structure in which the switch box (g) is fastened to the back plate (b) through a screw (h), the back plate (b) cannot be used as a bottom plate of the switch box (g). Consequently, the switch box (g) thickens by a thickness of the bottom plate (m). The switch, box (g) disadvantageously is apt to be displaced at its securing position, since it is fastened by the screw (h) after it is temporarily placed in position.

SUMMARY OF THE INVENTION

It is accordingly a primary object of the present invention to provide an improved lock device for vehicle doors which solves the problems of the prior art, in which the switch box (g) and the lock lever (f) aren't overlapped on each other.

According to the concept of the present invention, the switch box (g) and the lock lever (f) are arranged along a left-and-right direction or an up-and-down direction, and, in more detail, as shown by an arrow in FIG. 1 the switch box (g) can move to a large space A formed at a rear side of the actuator box (c).

In addition, when the switch box (g) is moved to a rear side of the actuator box (c), and the actuator box (c) and the switch box (g) are integrally formed according to the present invention, it is possible to omit the bottom plate (m) and its securing work.

EMBODIMENT

One embodiment of the lock device according to the present invention will be described with reference to the accompanying drawings.

Figure 3:
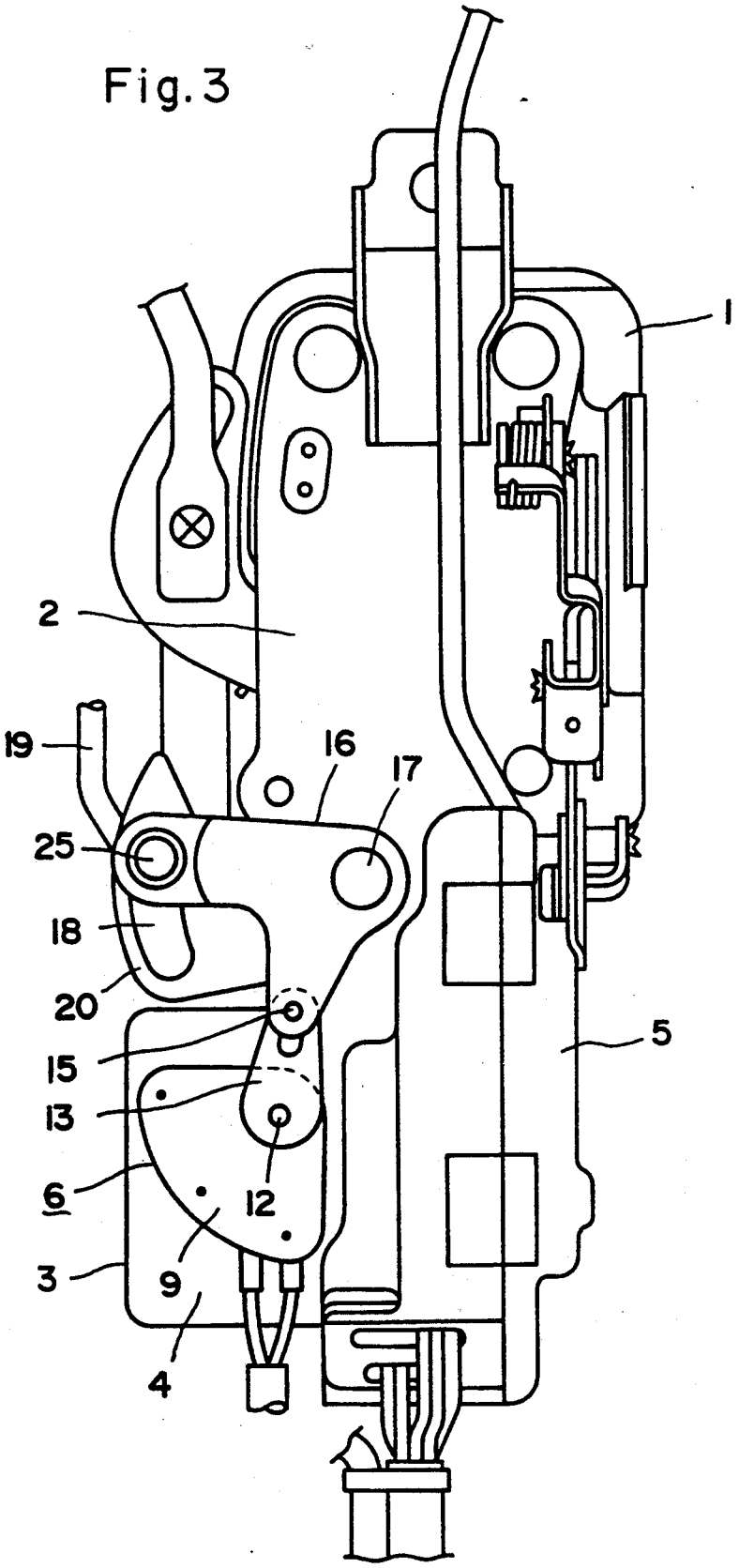
FIG. 3 is a rear view of the lock device according to the present invention.

As shown in FIG. 3, a flat metal cover plate (not shown) is applied to a front side of the synthetic resin or plastic body 1, and a similar cover plate 2 made of a flat metal sheet is applied to the rear side of the body 1. These members of the cover plates and the body 1 are integrally secured through a rivet or screw or the like. The body 1 has a dent or opening formed on the front side of the body, which dent is covered by the cover plate. A latch engaging with a striker secured to the vehicle body, and a ratchet engaging with the latch and preventing it from reverse-rotating are rotatably journalled to the dent as is well-known.

Figure 5:
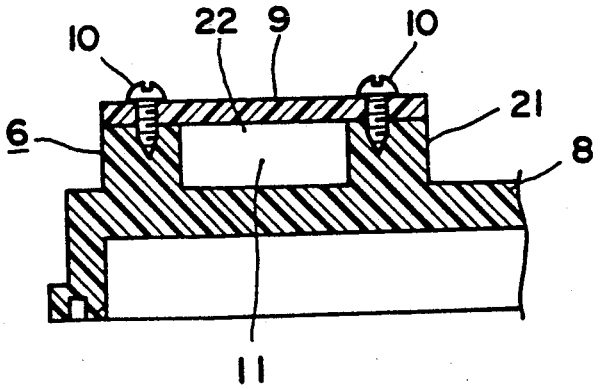
FIG. 5 is section of the actuator box and switch box.

An actuator box 3 made of synthetic resin is secured to the lower portion of the body 1. It is possible to mold the body 1 and the actuator box 3 integrally. The box 3 is divided into a front side member 7 and a rear side member 8. The space of the box 3 is divided into the motor chamber 4 containing a motor and a speed reducer 5 containing a set of gears. From the rear side member 8 of the motor chamber 4, a circumferential wall 21 constituting a part of the switch box 6 protrudes integrally. It is apparent, that the circumferential wall 21 has a ring shape as seen from above; a central dent or rear opening 22 formed by the ring-like wall 21 is closed by a lid plate 9 and the plate is secured by a number of set screws 10 as shown in FIG. 5. The plate 9 is adapted to be formed on a level substantially with the back plate 2, i.e. it is coplanar, or it is higher than the level of the back plate 2, i.e. it lies in a plane farther from the member 8 than the plane of the back plate 2.

A switch body consisting of a well-known fixed contact and a movable contact is secured in the space of the switch containing chamber 11 surrounded by the lid plate 9, the circumferential wall 21, and the rear side member 8. A rotation shaft 12 of the movable contact protrudes rearwardly through the lid plate 9 and a foundation of the switch arm 13 is secured to the protruded portion of the rotation shaft 12. A rotation end of the switch arm 13 has an oval hole 14 extending in direction of the arm.

The lock lever 20 is rotatably journalled to the position between the body 1 at its position near the motor chamber 4 and the back plate 2 through a shaft 17. The lock lever 20 is adapted to be changed-over by a motor placed in the actuator box. At one side of the lock lever 20, an oval hole 18 is formed. An end 25 of the rod 19 connected to the key cylinder is engaged with the oval hole 18. The rod extending to the sill knob is connected to another end 26 of the lock lever 20.

A rear end of the shaft 17 protrudes rearwardly through the back plate 2. An L-type connecting lever 16 is rotatably journalled to the protruded portion of the shaft 17. An engagement pin 15 protruding to the front side is placed at a leg 23 of the connecting lever 16 and one end 25 of the rod 19 is engaged with the other leg 24. The engagement pin 15 is adapted to engage with the oval hole 14 of the switch arm 13.

Figure 1:
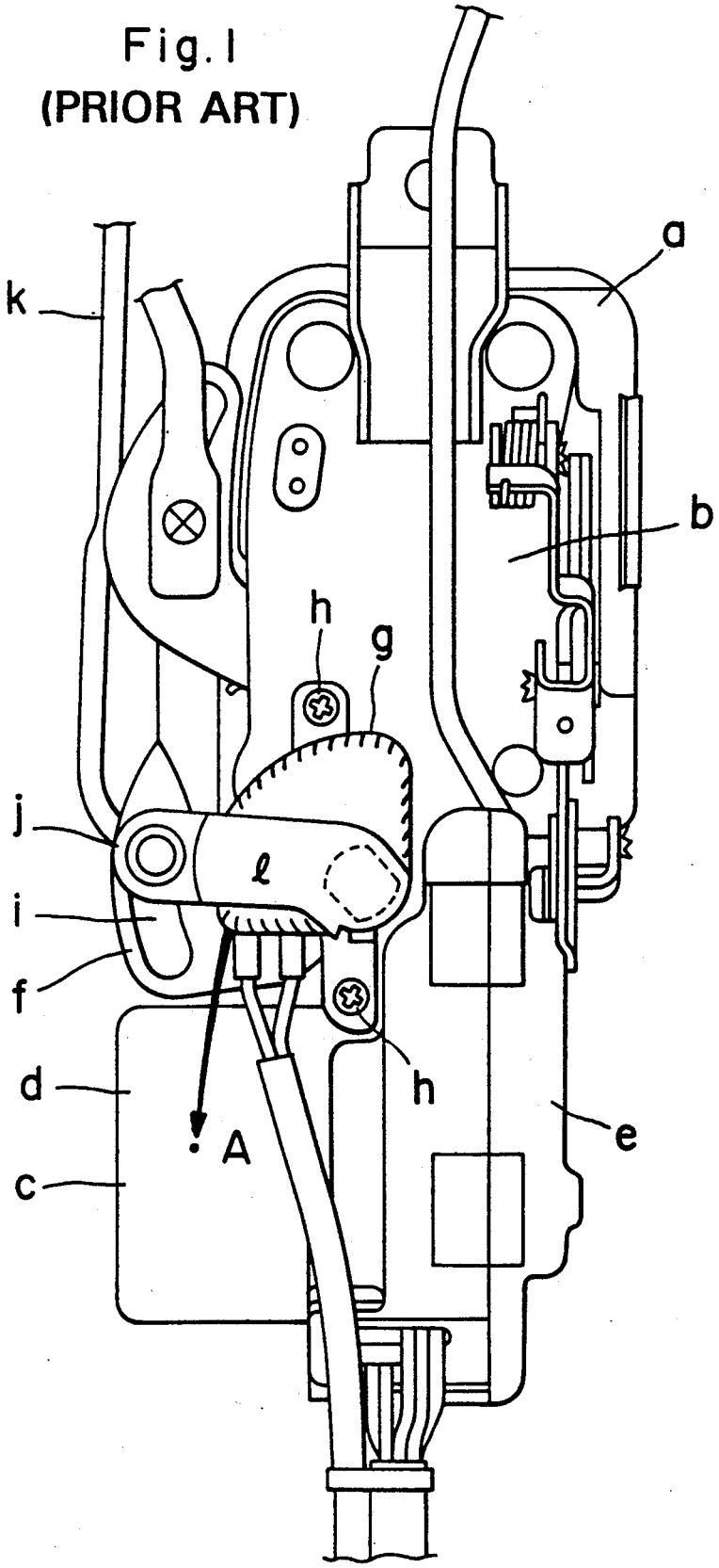
Fig. 1 (PRIOR ART)
FIG. 1 is a rear view of the lock device according to the previous invention of the applicant.
Figure 2:
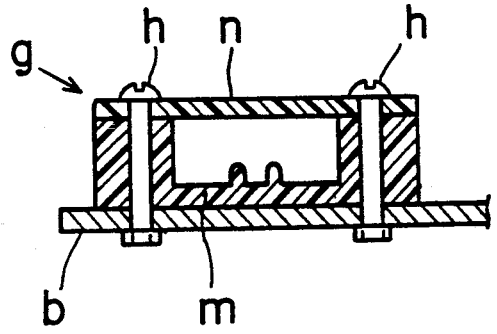
Fig.2 (PRIOR ART)
FIG. 2 is a sectional view of the conventional lock device.
Figure 4:
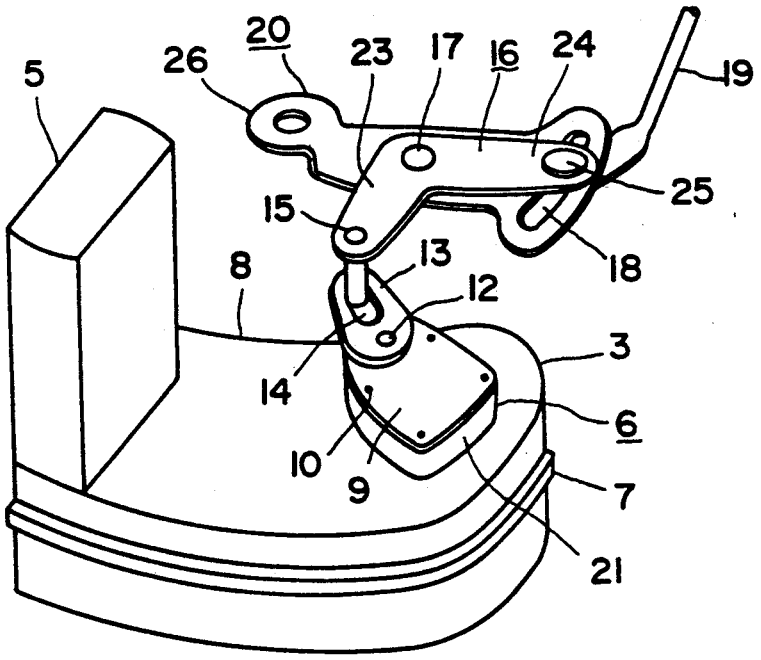
FIG. 4 a perspective view of the actuator device, switch box, and lock lever of the lock device according to the present invention.

According to the construction mentioned-above, the switch box 6 can move to a wide space formed at the rear side of the actuator box along the arrow shown in FIG. 1.

An operation of the lock device according to the present invention will be described.

FIG. 3 shows the lock lever 20 at its unlocked position and the key cylinder at its neutral position. When the key operates to rotate the key cylinder toward its locked side, the lock 19 moves upward to make the lock lever 20 rotate clockwise in order to change-over the lock device to its locked condition. Simultaneously, the connecting lever 16 connected to the rod 19 rotates clockwise and consequently the switch arm 13 rotates counterclockwise around the rotation shaft 12. Because the switch arm 13 is then secured to the rotation shaft 12, the rotation 12 and the movable contact respectively rotate, so that the switch body detects an changing-over to a locked condition of the lock device and outputs a control signal to lock devices of other door.

On the contrary, when the key rotates the key cylinder from the condition shown in FIG. 3 to its unlock side, only the rod 19 downs in the oval hole 18 and the lock lever 20 is not moved, but the switch body moves in a manner described above due to a rotation of the connecting lever.

According to the embodiment shown, when the locked condition of the key cylinder is changed-over to its unlocked condition by means of the sill knob, the switch body doesn't move due to the particular relationship between the oval hole 18 of the lock lever 20 and the connecting lever 16. Apparently the relationship between the lock device and the switch body is determined according to the design. For example, when the other leg 24 of the connecting lever 16 is directly connected to the lock lever 20, it is possible to make completely the switch body co-operative with the motion of the lock lever 20.

What is claimed is:

1. A vehicle door lock device comprising a synthetic resin body having a front side and a rear side and being provided with a latch rotatably engaged with a striker at the vehicle body ad a ratchet preventing said latch from reverse-rotating, a back plate attached to the rear side of the synthetic resin body, a lock lever installed between said back plate and the synthetic resin body so as to change-over the lock device between its locked condition and unlocked condition, an actuator box of synthetic resin having a front side and a rear side, installed below the synthetic resin body for containing a power source for changing-over the lock lever, a switch box adjacent the rear side of the actuator box, and a switch body in said switch box, a rotation shaft protruding rearward from said switch body through said switch box, a switch are mixed on the protruded portion of the rotation shaft, and a connecting lever having an end connected to the switch arm and another connected to a key cylinder of the door or the lock lever, wherein said switch body is electrically connected to lock devices of other doors so as to function cooperatively with motions of the key cylinder or the lock lever and output control signal for changing-over the lock devices of the other doors between a locked condition and an unlocked condition.

lock devices of other doors so as to function co-operatively with motions of the key cylinder or the lock lever and output control signal for changing-over the lock devices of the other doors between a locked condition and an unlocked condition.

2. The vehicle door lock device according to claim 1, wherein said switch box has a circumferential wall integrally formed as a protruding part of the actuator box and a lid differently formed from the actuator box, and a bottom plate of said switch box is used too as an outer wall of the actuator box.

3. The vehicle door lock device according to claim 2, wherein the lid of the switch box is coplanar with the back plate.

4. The vehicle door lock device according to claim 2, wherein the lid of the switch box lies in a plane farther from said rear side of said body than the plane of the back plate.

* * * * *